US006774751B2

(12) United States Patent
Bach et al.

(10) Patent No.: US 6,774,751 B2
(45) Date of Patent: Aug. 10, 2004

(54) CONNECTING BARS FOR ELECTRICAL DEVICES AND APPARATUS FOR DIFFERENT NOMINAL CURRENTS HAVING A CAVITY

(75) Inventors: Michael Bach, Berlin (DE); Detlev Schmidt, Berlin (DE); Michael Sebekow, Berlin (DE); Guenter Seidler-Stahl, Berlin (DE); Ingo Thiede, Berlin (DE); Sezai Tuerkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/312,531

(22) PCT Filed: Jun. 25, 2001

(86) PCT No.: PCT/DE01/02350

§ 371 (c)(1),
(2), (4) Date: Dec. 27, 2002

(87) PCT Pub. No.: WO02/01590

PCT Pub. Date: Jan. 3, 2002

(65) Prior Publication Data

US 2003/0106785 A1 Jun. 12, 2003

(30) Foreign Application Priority Data

Jun. 28, 2000 (DE) ..... 100 32 653

(51) Int. Cl.[7] ..... H01H 1/00

(52) U.S. Cl. ..... 335/196; 200/237; 200/284; 218/146

(58) Field of Search ..... 200/51 R–51.17, 200/237–284; 218/146; 335/6–45, 196–198

(56) References Cited

U.S. PATENT DOCUMENTS 3,597,713 A 8/1971 McClain et al.
6,100,490 A * 8/2000 Turkmen ..... 218/22

FOREIGN PATENT DOCUMENTS

DE 19643607 11/1997
DE 19939710 2/2001

* cited by examiner

*Primary Examiner*—James R. Scott
(74) *Attorney, Agent, or Firm*—Harness, Dickey & Pierce, P.L.C.

(57) ABSTRACT

Connecting bars are made from profiled semifinished products and have a cavity. The bars have the same outer dimensions for different nominal currents and are intended for connecting the electrical components of electrical devices and apparatus to an external electrical circuit. The connecting bars extend through the window opening located in the wall of the devices or apparatus and are fixed in the housing by a fixing device including two or more partial parts profiles. These are configured in such a way that they can be connected to one another by positive fit or otherwise to a hollow connecting bar. The partial parts have one or several legs, the length of which defines the height of the connecting bar.

19 Claims, 2 Drawing Sheets

CONNECTING BARS FOR ELECTRICAL DEVICES AND APPARATUS FOR DIFFERENT NOMINAL CURRENTS HAVING A CAVITY

This application is the national phase under 35 U.S.C. § 371 of PCT International Application No. PCT/DE01/02350, now published as WO 02/01590 which has an International filing date of Jun. 25, 2001, which designated the United States of America and which claims priority on German Patent Application number DE 100 32 653.6 filed on Jun. 28, 2000, the entire contents of which are hereby incorporated herein by reference.

FIELD OF THE INVENTION

The invention generally relates to connecting rails or bars. Preferably, it relates to those which are produced from profiled semi-finished products and are provided with a cavity, for connecting the electrical components of electrical appliances and apparatuses to an external circuit. More preferably, the connecting rails extend through window openings located in the appliance or apparatus wall and arc fixed in the housing by an attachment device.

BACKGROUND OF THE INVENTION

Connecting rails have been proposed in German Patent Application 199 39 710.4. In this way, by way of example, a system-side feeder rail or some other suitable connection element for supplying or outputting power can be connected to the part of a connecting rail which is passed out of the housing to the exterior. The connecting rail is in this case generally arranged fixed in the insulating wall body of an appliance or apparatus, and this is generally achieved by means of bushing openings and attachment elements.

The connecting rails also have to be designed such that they can be produced economically and are suitable for carrying out specific functions. These functions are: the current-carrying capacity, heat dissipation, a surface for connections for feeder rails as well as absorbing and transmitting static and dynamic forces. This is thus a point which is subject to high stresses both in terms of forces and dynamically.

Furthermore, it is also intended to be possible to accommodate connecting rails for different current levels in one standard housing with standard bushing openings. In conventional appliances and apparatuses, screws are used as the attachment device for the connecting rail, which extend through openings which are arranged transversely with respect to the longitudinal axis of the connecting rails, and which are generally held by a female thread provided in the wall of the corresponding housing. For mechanical strength reasons, metallic recessed nuts or push-in nuts are used for this purpose, in a housing which is composed of an insulating material.

In consequence, the production and installation of such connecting rails is associated with high material and manufacturing costs. The use of connecting rails which are sawn from a profile material with one or more projections, such that the connecting rails are passed through a hole and the projection or projections of the profile material is or are used as stops for the connecting rail on the switch housing, thus forming the means for transferring the switching forces to the housing, has therefore been proposed, for example for low-voltage circuit breakers.

This on the one hand results in the position of the fixed contact with respect to the housing being defined in switches such as these while, on the other hand, the attachment point is relieved of the load from said forces so that only a fixing force is required here, but no load is produced by the shear force or positioning force.

A connecting rail such as this for a low-voltage circuit breaker, having an integrally formed projection, has been proposed for overcoming the above mentioned cost in DE 196 43 607 A1. This connecting rail is passed from the inside through the bushing opening in the housing wall, and is supported on the housing rear wall by means of a projection. Special profiles are used for producing this connecting rail, which have an integrally formed strip, from which pieces are then cut off in order to form the connecting rail.

In the case of low-voltage circuit breakers, it has until now been normal to use connecting rails of different thickness, depending on the rated current, within one range. These connecting rails are likewise produced from profiles by sawing. The housing has standard cutouts for the connecting rails, which are each designed for the highest rated current level. Spacers which are made of plastic and fill the intermediate spaces are used for thinner connecting rails, for lower rated current levels. The installation of the spacers has the disadvantage of additional costs for these parts, as well as increased installation costs, and they form a fault source when current paths are installed at the customer end.

In all these known electrical appliances and apparatuses, the connecting rails are produced from solid material, irrespective of the rest of the production technology. This means that the rails also have different cross sections for different current levels, and thus have different external dimensions; a disadvantage which has already been mentioned above.

Hollow current-carrying conductors are known from high-voltage and radio-frequency technology. In these hollow conductors, the hollow configuration is used only for the purpose of reducing the corona-discharge losses from the conductors, that is to say the emission of energy from sharp edges or small radii, or to take account of the skin effect, which is based on the fact that power is transmitted only in the outer region of a conductor at high frequencies, but not for the purpose of ensuring a different current load capacity with a standard external cross section.

A current-carrying hollow arrangement is also described in U.S. Pat. No. 3,597,713, which discloses an appliance as a replacement for a high-voltage fuse link, in which a combination of a vacuum interrupter with a switching handle is described, which switching handle has an eye for operation, in a similar way to a high-voltage or medium-voltage switch disconnector. An electronic circuit is installed in a hollow connecting piece of the appliance. Although this means that a current-carrying hollow part on an electrical switching device has been disclosed, this is, however, used only to accommodate another component of the appliance, namely said electronic circuit, and not for controlling the current-carrying capacity of the component.

In another reference, it has already been proposed for hollow connecting rails to be used for low-voltage circuit breakers, which are produced by sawing them from hollow profile material and which may have not only one but also a number of cavities. In this case, these connecting rails have the same external cross section for all the different current levels. The current-carrying capacity is regulated by means of the wall thickness of the hollow rail, which forms the conductive, current-carrying cross section. This means that a larger inner cavity is formed by virtue of small wall thicknesses for relatively low current levels, and that a smaller inner cavity is formed as a result of the wall thicknesses being greater for relatively high current levels, which, in the extreme, can lead to a solid configuration without any cavity for the maximum rated current level. The bushing openings in the respective appliance and apparatus housings are then designed for the external dimensions required for the maximum rated current level. The production of such hollow profiles from a number of materials which are preferably used for the production of such connecting rails is, however, associated with considerable difficulties.

SUMMARY OF THE INVENTION

An object of an embodiment of the present invention is therefore to design hollow connecting rails such that they have the same external cross section even for different rated current values and can be used without any additional spacers in appliance and apparatus housings with standard bushing openings, but in which the problems involved in the production of hollow semi-finished profiles can be avoided.

According to an embodiment of the present invention, this object may be achieved in that the cavity in the connecting rail is produced by the connecting rail being composed of two or more piece elements, which are in the form of profiles and are designed such that they can be connected to one another in an interlocking manner or in some other way to form a hollow connecting rail. Such profile elements can be manufactured easily and without the problems which occur with the production of hollow profiles.

The connecting rail is preferably assembled from two profiled piece elements, of which the first piece element forms the upper part of the connecting rail and the second piece element forms the lower part of it. This results in planar upper and lower rail surfaces, which is particularly important with respect to use for push-in switches, in order to ensure that they slide correctly into the push-in blade contacts. The piece elements have one or more limbs whose lengths govern the height of the connecting rail. This means that the connecting rails have the same external dimensions for all current levels, corresponding to the standard dimensions of the bushing windows in the rear wall of the low-voltage circuit breaker. The current-carrying capacity of the connecting rail is in this case governed by the thickness of the material.

One or more limbs of each piece element is or are expediently provided with connection elements, which engage in an interlocking manner in mating elements on the respective other piece element.

Three limbs are advantageously provided, of which two are arranged on one piece element and one is arranged on the other piece element. This makes it easier to manufacture the piece elements than if all the limbs were arranged on one piece element. The piece elements are connected to one another by use of one or more interlocking connections and/or partially by soldering, welding or the like. Any holes required for attachment of the system-side busbars are advantageously stamped.

BRIEF DESCRIPTION OF THE DRAWINGS

The invention will be explained in more detail in the following text, to assist understanding, with reference to a preferred exemplary embodiment, although this does not restrict the scope of protection.

DETAILED DESCRIPTION OF THE PREFERRED EMBODIMENTS

Figure 1:
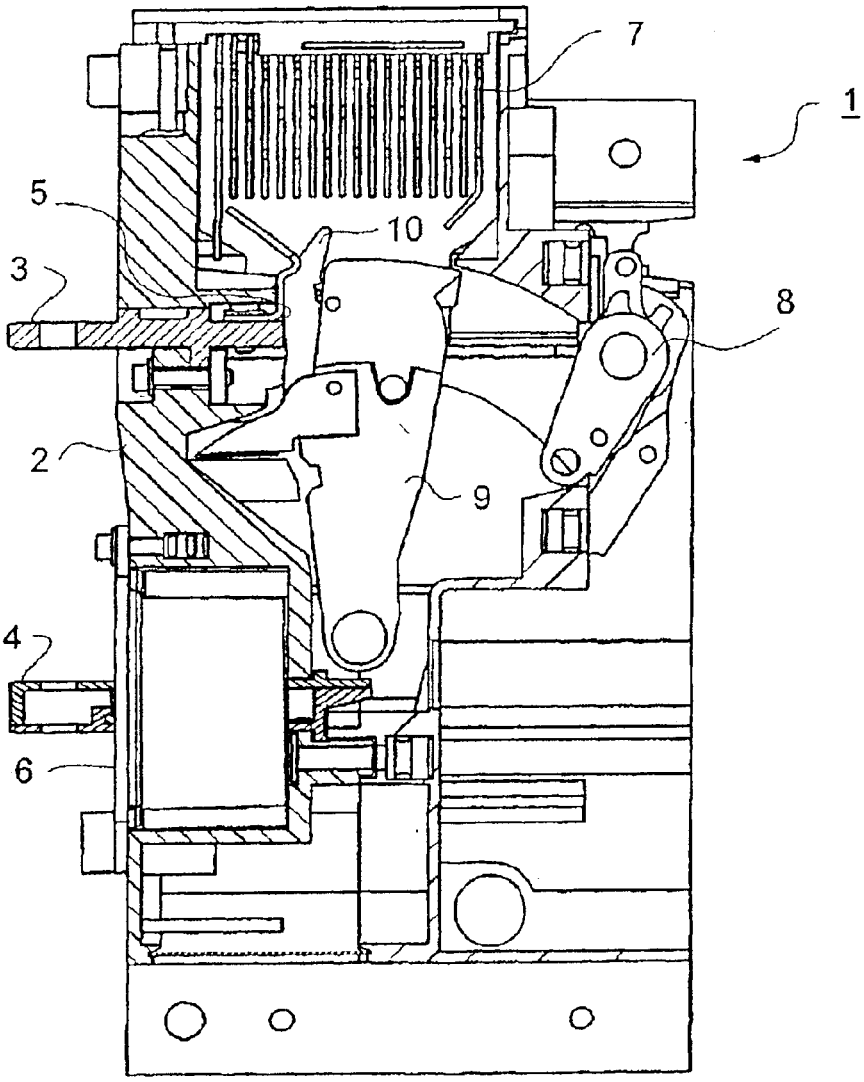
FIG. 1 shows, schematically, a section view of a low-voltage circuit breaker.

FIG. 1 shows a low-voltage circuit breaker 1, schematically and in the form of a section view. The upper connecting rail 3, which is shown in conventional form, and the lower connecting rail 4, which is illustrated in the form according to an embodiment of the invention and is passed through the current transformer 6, are passed through the rear wall 2 of the low-voltage circuit breaker 1. The fixed switching contact 5 is located on the upper connecting rail 3 and the moveable switching contact 10, which is located on a contact support 9 that is connected to the switch drive 8, is connected to the lower connecting rail 4, via flexible connections which are not shown. The arcing chamber 7 is arranged above the fixed switching contact 5 and the moveable switching contact 10.

Figure 2:
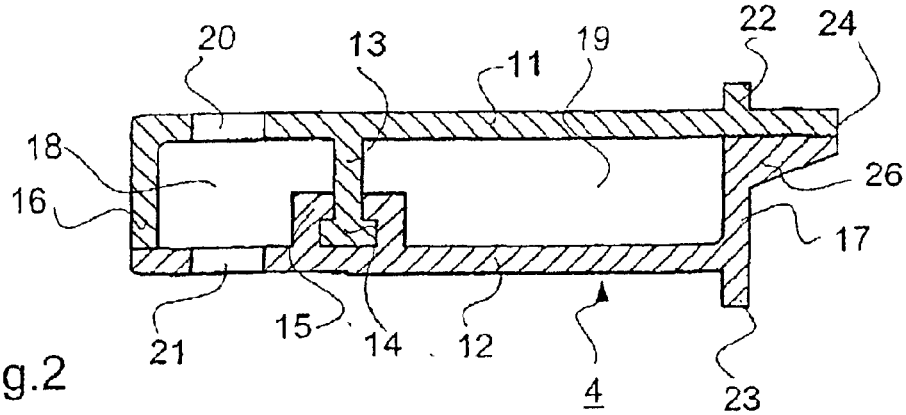
FIG. 2 shows a section view of one possible advantageous embodiment of a lower connecting rail according to the present invention.

FIG. 2 shows one possible advantageous embodiment of a lower connecting rail 4 according to an embodiment of the present invention, in the form of a side view. This comprises a profiled upper piece element 11 and a likewise profiled lower piece element 12. These are connected to one another in an interlocking manner by pushing one into the other, by means of a web 13 which is provided on the upper piece element 11, has a transverse web 14 located at its end and has a guide rail 15 provided on the lower piece element 12. In addition, the upper piece element 11 has an angled part 16, and the lower piece element 12 has a part 17 arranged at right angles, both of whose dimensions are designed such that they form connection webs between the upper piece element 11 and the lower piece element 12, with their lengths governing the height of the connecting rail 4. In addition to the interlocking connection described above, the two piece elements 11, 12 are additionally connected to one another by soldering, welding or the like at the points where the part 16 makes contact with the lower piece element 12 and where the part 17 makes contact with the upper piece element 11.

The described arrangement results in a hollow connecting rail 4, which has two cavities 18, 19. Holes 20, 21 are provided for attachment of the system-side busbars, and are expediently produced by stamping. The projections 22, 23 are used as stops for axial fixing of the connecting rail 4 on the switch housing.

Figure 3:
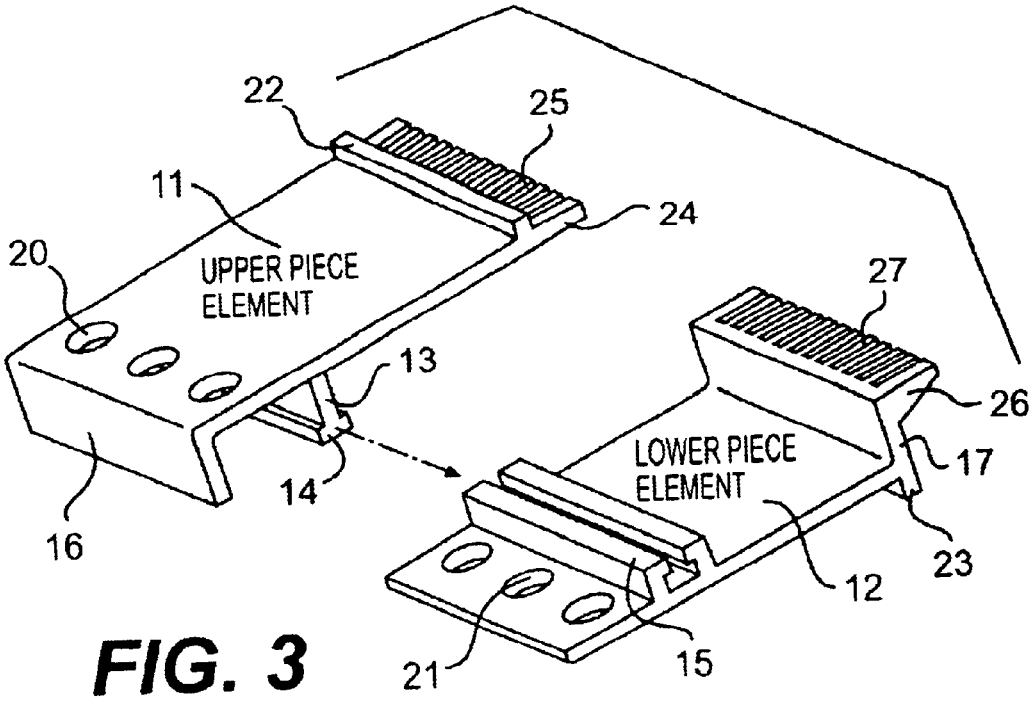
FIG. 3 shows a perspective illustration of the connecting rail shown in FIG. 2, in the state before the piece elements are joined together.
Figure 4:
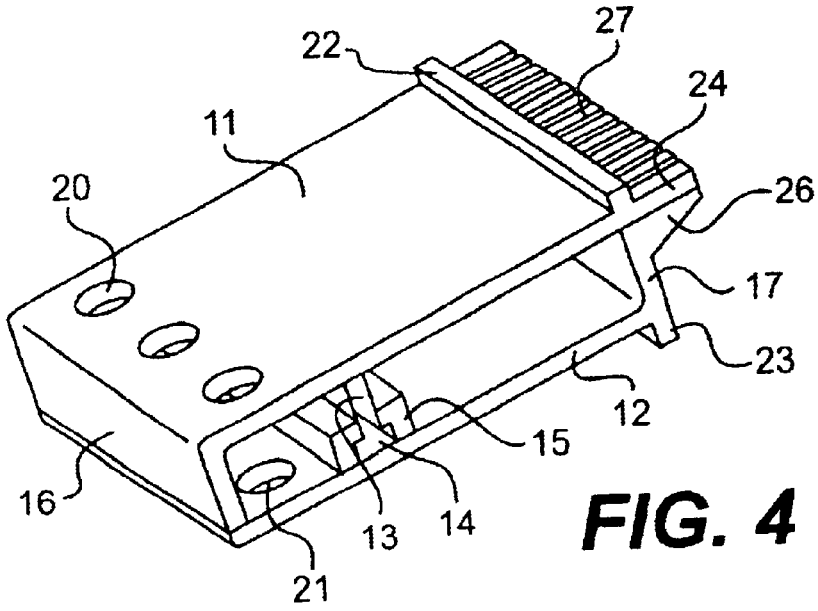
FIG. 4 shows a perspective illustration of the connecting rail shown in FIG. 2, after the piece elements have been joined together.

FIG. 3 shows a perspective illustration of the connecting rail 4 shown in FIG. 2, in the state before the piece elements 11, 12 have been joined together, and FIG. 4 shows the same connecting rail 4 after the piece elements 11, 12 have been joined together, likewise in the form of a perspective illustration. Identical parts from FIG. 2 are provided with the same reference symbols in these figures, and there is therefore no need to describe these parts once again. The two FIGS. 3 and 4 are intended only to illustrate more clearly the function of the web 13 with its transverse web 14 and the guide rail 15. These elements provide a first fixing for the two piece elements 11, 12, in order to make it easier to connect them by soldering or welding to the other contact points mentioned above.

Cutouts 25 are provided in an extension 24 on the upper piece element 11 for attachment of the flexible conductor cables which connect the lower connecting rail to the moveable switching contacts. The part 17, which is arranged at right angles, of the lower piece element 12 has a projection 26, in which cutouts 27 are likewise provided, which are aligned with the cutouts 25 in the upper piece element 11 so that the flexible conductor cables mentioned above can be inserted into the cutouts 25, 27 in the two piece elements 11, 12. In consequence, the two piece elements 11, 12 are electrically connected to the conductor cables while said conductor cables are being soldered or welded in and, in consequence, are subject to uniform current loads. The cutouts 25, 27 may, of course, also be milled after assembly.

The advantage of this embodiment according to the invention is that these profile elements are easy to produce. The current-carrying capacity of the connecting rail is governed by the thickness of the material and not by the external dimensions.

List of Reference Symbols

1 Low-voltage circuit breaker
2 Rear wall
3 Upper connecting rail
4 Lower connecting rail
5 Fixed switching contact
6 Current transformer
7 Arcing chamber
8 Switch drive
9 Contact support
10 Moveable switching contact
11 Upper piece clement
12 Lower piece element
13 Web
14 Transverse web
15 Guide rail
16 Angled part
17 Part
18 Cavity
19 Cavity
20 Hole
21 Hole
22 Projection
23 Projection
24 Extension
25 Cutout
26 Projection
27 Cutout The invention being thus described, it will be obvious that the same may be varied in many ways. Such variations are not to be regarded as a departure from the spirit and scope of the invention, and all such modifications as would he obvious to one skilled in the art intended to be included within the scope of the following claims.

What is claimed is:

1. A connecting rail for devices of different rated currents, comprising:

a cavity, wherein the connecting rail is produced from profiled semi-finished products and is for connection of an electrical component of the electrical appliance or apparatus to an external circuit, and wherein the connecting rail extends through a window opening located in the appliance or apparatus wall and is fixed by an attachment device; and at least two elements, in the form of profiles and designed such that they can be connected to one another to form a hollow connecting rail.

2. The connecting rail as claimed in claim 1, wherein the connecting rail is composed of two profiled piece elements, of which the first piece element forms an upper part of the connecting rail and the second piece element forms a lower part of the connecting rail.

3. The connecting rail as claimed in claim 1, wherein the piece elements have at least one limb whose length determines the height of the connecting rail.

4. The connecting rail as claimed in claim 1, wherein at least one limb of each piece element is provided with connection elements which engage in an interlocking manner in mating elements on the respective other piece element.

5. The connecting rail as claimed in claim 1, wherein three limbs are provided, of which two limbs are arranged on one piece element and one limb is arranged on the other piece element.

6. The connecting rail as claimed in claim 1, wherein the piece elements are connected to one another by at least of one interlocking connection and at least one of partially by soldering or welding.

7. The connecting rail as claimed in claim 1, wherein at least one hole, required for attachment of the system-side busbars, are stamped in at least one piece element.

8. A connecting rail as claimed in claim 1, wherein at least two elements are connected to one another in an interlocking manner to form a hollow connecting rail.

9. A connecting rail as claimed in claim 1, wherein at least two elements are connected to one another in another manner to form a hollow connecting rail.

10. A connecting rail for devices of one of a plurality of different rated currents, comprising:

at least two profiles, designed to be connectable together so as to form at least one cavity, wherein the profiles are semi-finished products, the connecting rail being for connection of an electrical component to an external circuit.

11. The connecting rail of claim 10, wherein the connecting rail is for extending through a window opening located in the an appliance or apparatus rear wall including the electrical component and is fixed by an attachment device.

12. The connecting rail as claimed in claim 10, wherein the connecting rail includes two profiled piece elements, of which the first piece element forms an upper part of the connecting rail and the second piece element forms a lower part of the connecting rail.

13. The connecting rail as claimed in claim 12, wherein the profiles have at least one limb whose length determines the height of the connecting rail.

14. The connecting rail as claimed in claim 13, wherein at least one limb of each profile is provided with connection elements which engage in an interlocking manner in mating elements on the respective other profile.

15. The connecting rail as claimed in claim 13, wherein three limbs are provided, of which two limbs are arranged on one profile and one limb is arranged on the other profile.

16. The connecting rail as claimed in claim 10, wherein the profiles are connected to one another by at least of one interlocking connection and at least one of partially by soldering or welding.

17. The connecting rail as claimed in claim 10, wherein at least one hole, required for attachment of the system-side busbars,are stamped in at least one profile.

18. The connecting rail of claim 10, wherein the connecting rail has the same external cross section for different rated current values.

19. The connecting rail of claim 1, wherein the connecting rail has the same external cross section for different rated current values.

* * * * *